US005149202A

United States Patent [19]

Dickert

[11] Patent Number: 5,149,202

[45] Date of Patent: Sep. 22, 1992

[54] CONTAINER STRUCTURE HAVING TRANSPARENT OUTER POUCH

[76] Inventor: James Dickert, 1657 Old Oak Pl., Darien, Ill. 60559

[21] Appl. No.: 558,221

[22] Filed: Jul. 26, 1990

[51] Int. Cl.[5] ..... B65D 30/22

[52] U.S. Cl. ..... 383/106; 383/39; 383/40

[58] Field of Search ..... 383/38, 39, 40, 106; 229/74, 71

[56] References Cited

U.S. PATENT DOCUMENTS

| | | | |
|---|---|---|---|
| 2,015,119 | 9/1935 | McEwen | 383/40 |
| 2,067,948 | 1/1937 | Potolevin | 229/71 X |
| 2,565,167 | 8/1951 | Brès | 383/38 X |
| 2,654,527 | 10/1953 | Geckler et al. | 383/40 |
| 2,793,743 | 5/1957 | Lefebvre | 383/40 X |
| 3,235,168 | 2/1966 | Nichols | 383/106 X |
| 3,804,323 | 4/1974 | Bemel | 206/831 X |
| 4,393,989 | 7/1983 | Maclin et al. | 229/71 |
| 4,549,658 | 10/1985 | Sfikas | 229/74 X |
| 4,648,860 | 3/1987 | Cassey | 383/40 X |
| 4,795,268 | 1/1989 | Jordá | 383/40 |

FOREIGN PATENT DOCUMENTS

| | | | |
|---|---|---|---|
| 190385 | 8/1986 | European Pat. Off. | 383/38 |
| 3024943 | 1/1982 | Fed. Rep. of Germany | 383/38 |
| 345441 | 3/1931 | United Kingdom | 229/71 |
| 1274010 | 5/1972 | United Kingdom | 229/74 |
| 2211079 | 6/1989 | United Kingdom | 383/40 |

*Primary Examiner*—Stephen Marcus
*Assistant Examiner*—Jes F. Pascua
*Attorney, Agent, or Firm*—Evelyn M. Sommer

[57] ABSTRACT

An improved container structure is formed from a tube blank and a layer of transparent, plastic material having at least one pair of opposed edges adhered to the outer surface of the tube blank, in order to form a clear outer pouch on the container for convenient insertion of promotional or visual material. In the preferred embodiments, an improved paper bag has the clear outer pouch formed over either its face panel, gusset panel, or back panel. The pouch may be formed with a lateral cut dividing an upper part of the transparent layer which is adhered to the container surface, and a lower part which is not adhered and forms a lower pouch. The pouch may similarly be formed on cartons of paperboard, laminate, plastic, and other stock materials.

8 Claims, 1 Drawing Sheet

CONTAINER STRUCTURE HAVING TRANSPARENT OUTER POUCH

FIELD OF THE INVENTION

This invention generally relates to a container structure, and more particularly, to a paper bag structure having means for convenient display of promotional or visual material.

BACKGROUND ART

Specialty bags are conventionally made from blanks cut from a single-ply or duplex (2-ply) sheet of stock material, such as paper, that is sealed along a longitudinal edge to form a tube and then sealed at one end of the tube to form a square-folded (SOS) bottom or a pinch bottom. In the 2-ply structure, the inner ply is typically a laminated plastic or foil film to provide barrier protection from a product which may contain oils or other ingredients which would affect the outer ply of the bag. Some bags may have a window which allows the product contained therein to be visible. The window is typically formed either by patching a window material on the inside of an aperture in a single-ply structure, or by cutting a window opening from the outer ply of a 2-ply structure and relying on the laminated inner film (such as polypropylene) to provide the see-through feature as well as the barrier protection.

In the fast foods and packaged products industries, promotional material is often distributed in conjunction with bags or cartons for a product. For example, flyers, gifts, coupons, and premiums are often dropped into a bag or inserted in a carton along with the product. Such insertions may become soiled by foods contained in the bag or carton, or may not be visible from the outside, thereby losing their promotional appeal. It is therefore desirable in these industries to have an improved bag or carton structure which allows promotional material to be fully visible and to remain clean and aesthetically pleasing to the consumer.

SUMMARY OF THE INVENTION

In accordance with the invention, an improved container structure comprises:

a blank of sheet material formed in a tube having inner and outer surfaces, a given longitudinal length, and top and bottom ends, at least the bottom end of which is sealed to form an at least partially enclosed container; and a layer of transparent, plastic material having a surface area defined by opposed pairs of longitudinal edges and lateral edges, wherein at least one pair of said edges are secured to said outer surface of said container, and wherein at least one edge and at least a portion of said surface area is not secured to said outer surface of said container, thereby forming a transparent pouch on said outer surface of said container for insertion of a desired visual material therein.

In preferred embodiments of the invention, the improved container structure is a paper bag structure having a folded square bottom end and face and back panels and gusset panels on the sides thereof, and the transparent plastic layer has longitudinal edges secured to the gusset panels to form the transparent outer pouch over either the face panel, gusset panel, or back panel, depending upon the marketing requirements for the premium insert or the graphics for the bag. The transparent plastic layer may have a lateral cut formed therein and an upper part of the surface area thereof sealed to the container surface, while a lower part is not secured, in order to form a lower pouch. The transparent outer pouch may similarly be formed on cartons of paperboard, laminate, and other stock materials.

The improved container structure allows the premium material to be easily inserted in the exterior pouch and to be carried in and fully visible from the pouch without coming into contact with the product in the container. The inserted premium thus has an aesthetically pleasing appearance and can optimally fulfill its intended merchandising purpose. The pouch location, size, and orientation can be readily varied with the manufacture of the container blanks, depending upon the desired premium type, size, or shape.

Other objects, features, and advantages of the present invention will become apparent from the following detailed description of the best mode of practising the invention when considered in conjunction with the drawings, as follows:

DESCRIPTION OF THE PREFERRED EMBODIMENTS

Figure 1:
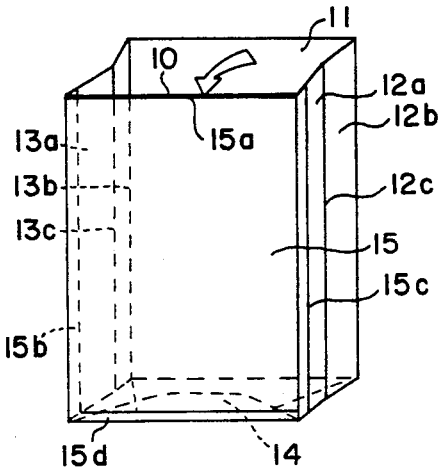
FIG. 1 is a schematic perspective view of an improved paper bag structure in accordance with the invention.

Referring to FIG. 1, one embodiment of the improved container structure in accordance with the invention is a paper bag of the type having a square-folded (SOS) bottom. The bag structure includes a face panel 10, a back panel 11, and gusset panels 12*a*, 12*b* and 13*a*, 13*b* on opposite sides thereof. A bottom end 14 is shown sealed in a square-folded configuration. The gusset panels are creased or scored along lines 12*c* and 13*c*, respectively to allow the panels to fold inwardly, so that the bag can be folded flat prior to usage.

A layer 15 of transparent, plastic material has its longitudinal edges 15*b*, 15*c* and a bottom edge or portion 15*d* adhered to the outer surface of the paper bag along its gusset panels 12*a*, 13*a* and bottom end 14, in order to form a clear pouch over the face panel 10 of the bag. Promotional or visual material can then be conveniently inserted in the pouch through the unadhered edge 15*a*, as indicated by the arrow in the figure, such that it is carried in and fully visible from the pouch.

For the manufacture of the improved container structure, a blank is cut from sheet material, such as paper, laminate, and other stock materials, and formed in a tube by sealing two longitudinal edges together, as is well known. The tube has inner and outer surfaces, a given longitudinal length, and top and bottom ends. The layer 15 of transparent, plastic material is cut having a given surface area defined by opposed pairs of longitudinal edges and lateral edges. At least one pair of the edges is secured to the outer surface of the tube blank. For the embodiment in FIG. 1, the longitudinal edges 15*b*, 15*c* and a bottom lateral edge or portion 15*d* of the transparent layer are sealed to the gusset panels 12*a*, 13*a* and a portion of the bottom end 14 of the tube blank, respectively. The bottom end is then folded or otherwise sealed to close that end of the bag, leaving the transparent pouch open along its top edge 15*a* and over its surface area co-extensive with the face panel, for insertion of any desired visual material therein.

The paper stock may be of the type having a polyethylene or other plastic film laminated over its outer surface. The transparent plastic pouch layer can be heat sealed to the thermoplastic outer surface of the tube blank for convenient manufacture. Alternatively, the pouch layer can be sealed with a clear adhesive. The pouch layer may be made from any desired transparent or semi-transparent materials, for example, mylar (which has high strength), stretch film (for flexibility), polyester (for clarity and barrier resistance), heat-shrink film, etc. The paper stock may be colored or preprinted for aesthetic effect. The transparent plastic layer allows the background color or printing on the outer surface of the container to remain visible in areas not occupied by the promotional material, and thus allows the promotional material to be displayed in conjunction with the background logo, images, or text of a particular vendor.

On the bottom end of the bag, the bottom edge or portion of the pouch is closed off by a cross seal, heat seal, or area seal. This is suitable for an SOS or pinch bottom style of bag. The top edge of the pouch may be formed with a closure to retain the visual material in the pouch. For example, it may have a foldover closure or a pressure sensitive tape closure. If the visual material is to be inserted in the pouch during bag manufacture, a top cross seal of the plastic material can be used to encapsulate the visual material. The open edge of the pouch may also have a colored or marker strip to clearly mark and/or reinforce the insertion edge of the pouch.

Figure 2:
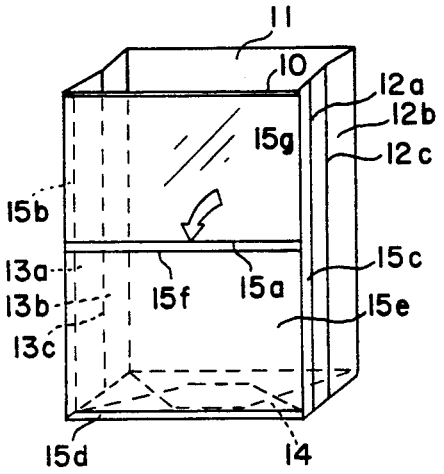
FIG. 2 is a schematic perspective view of a modification of the improved paper bag structure of FIG. 1.

In FIG. 2, a modified version of the bag structure is shown having a lateral cut to form an insertion pouch 15*e* at a lower part of the bag. The resulting open edge 15*a* is also shown having a band 15*f* to mark, seal, and/or reinforce the opening. The upper part 15*g* of the transparent plastic layer is sealed to the upper part of the outer surface of the bag (indicated with cross-hatching) to close it off from insertion. The visual material is thus carried in the lower pouch 15*e*, such that the upper part of the bag can be gripped, folded over, or closed without obscuring the visual material. For example, the top end of the bag may have traditional closures such as a tin tie closure, a foil fold-rollover closure, a pressure sensitive tape closure, or a simple foldover closure without mechanical seal. The above-described partial depth pouch can also be used to allow the premium or promotional material to project from the pouch to allow ready retrieval by the consumer and be more attractive for merchandising purposes.

Figure 3:
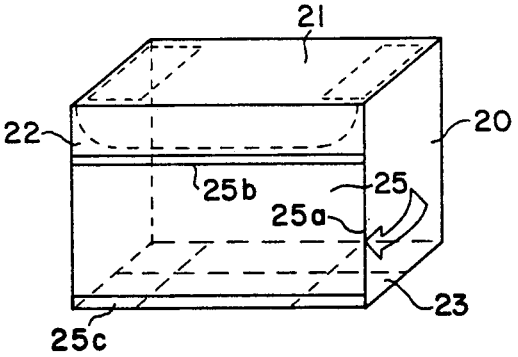
FIG. 3 is a schematic perspective view of an improved carton structure in accordance with the invention.

In FIG. 3, another embodiment has the clear outer pouch applied to a carton or box-type container. The carton 20 is typically formed from a tube blank of paperboard, laminate, or other suitable stock material. The tube blank is diecut, folded, and/or sealed to form an upper flap 21, carton walls including a front wall 22, and a bottom end 23. In this version, the pouch 25 is shown oriented laterally with sealed lateral edges 25*b*, 25*c* and an open edge 25*a* at one or both lateral sides.

Figure 4:
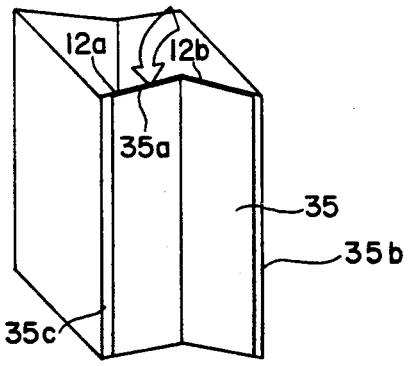
FIG. 4 shows another modification of the improved paper bag structure.

In FIG. 4, another modification of the paper bag structure has the clear outer pouch 35 formed over the gusset panels 12*a*, 12*b* on one or both folded sides of the paper bag. The longitudinal edges 35*b*, 35*c* of the transparent plastic layer are sealed or glued to the edges of the gusset panels. This modified version is particularly useful where graphic images and/or text is to be printed on the face and back panels of the bag. Add-on promotional material may then be inserted in the pouch at the sides of the bag.

In summary, the invention provides a convenient means for carrying insertable promotional or visual materials on the outside of a container where they can remain visible and unsoiled for the consumer. The clear outer pouch can be readily applied to the a bag or carton tube blank using conventional manufacturing methods. The insertion pouch is versatile as to location, orientation, and size according to any desired display requirements. The visual material is carried, protected, visible, and/or sealed in the pouch for display and protection. For paper bags, the insertion pouch provides added premium or product promotion display area.

Numerous modifications and variations are of course possible in light of the principles of the invention disclosed above. All such modifications and variations are intended to be included within the spirit and scope of the invention, as defined in the following claims.

I claim:

1. An improved container structure comprising:

a blank of sheet material formed with a face panel and a back panel each having the same surface area and being respectively defined by opposed pairs of longitudinal edges and upper and lower lateral edges, gusset panels at opposed lateral sides thereof defined by opposed pairs of longitudinal edges and upper and lower depthwise edges, an open top end, and a closed bottom end, said face, back, and gusset panels having inner and outer surfaces; and a layer of transparent, plastic material having a surface area defined by opposed pairs of longitudinal edges and upper and lower lateral edges which is substantially equal to the surface area of said face or back panel, wherein said transparent plastic layer has three of its four longitudinal and lateral edges secured respectively to corresponding longitudinal edges on the outer surface of the side gusset panels and the lower lateral edge of the front or back panel, thereby forming a transparent pouch over substantially the entire surface area of the front or back panel on said outer surface of said container for insertion of a desired visual material therein, wherein said transparent plastic layer has a lateral cut formed therein to provide an open edge, and an upper part of the surface area thereof above said cut is sealed to the outer surface of the container, while a lower part of the surface area thereof below said cut is not secured to the outer surface of the container, thereby forming a lower pouch on the outer surface of the container; and wherein said open edge not secured to the outer surface of the container has a band secured in registration along said open edge to mark and reinforce said edge.

2. An improved container structure according to claim 1, wherein said sheet material is paper or laminate thereof, and said container is a paper bag.

3. An improved container structure according to claim 1, wherein said sheet material is paperboard or laminate thereof, and said container is a carton.

4. An improved container structure according to claim 1, wherein said outer surface of the sheet material for the tube blank has a thermoplastic film, and said at lest one pair of edges secured to the outer surface of the container is heat-sealed thereto.

5. An improved container structure according to claim 1, wherein said at least one pair of said edges of said transparent plastic layer secured to said outer surface of said container are longitudinal edges of said transparent plastic layer, so as to form an outer pouch oriented in a longitudinal direction.

6. An improved container structure according to claim 1, wherein said at least one pair of said edges of said transparent plastic layer secured to said outer surface of said container are lateral edges of said transparent plastic layer, so as to form an outer pouch oriented in a lateral direction.

7. An improved container structure according to claim 1, wherein said transparent plastic layer is made from a material selected from the group consisting of mylar, stretch film, polyester film, and heat-shrink film.

8. An improved container structure according to claim 1, wherein said outer surface of said container is colored or preprinted so as to be visible through said transparent plastic layer of the outer pouch.

* * * * *